US006493911B1

(12) United States Patent
Troin et al.

(10) Patent No.: US 6,493,911 B1
(45) Date of Patent: Dec. 17, 2002

(54) CINERARY URN FORMING AN ELEMENT OF A FUNERARY COLUMN AND METHOD FOR MAKING SUCH URNS IN STONE

(75) Inventors: Robert Troin, Salernes (FR); Stephane Troin, Salernes (FR)

(73) Assignee: Societe des Fontaites, Salernes (FR)

( * ) Notice: Subject to any disclaimer, the term of this patent is extended or adjusted under 35 U.S.C. 154(b) by 0 days.

(21) Appl. No.: 09/719,074

(22) PCT Filed: Dec. 9, 1998

(86) PCT No.: PCT/FR98/02676

§ 371 (c)(1),
(2), (4) Date: Feb. 5, 2001

(87) PCT Pub. No.: WO99/64701

PCT Pub. Date: Dec. 16, 1999

(30) Foreign Application Priority Data

Jun. 9, 1998 (FR) ..... 98 3473

(51) Int. Cl.[7] ..... A61G 17/00

(52) U.S. Cl. ..... 27/1; 220/4.27; 125/20; 52/134

(58) Field of Search ..... 27/1, 35; 125/20; 451/61; 206/503, 508, 509; 220/801, 4.27; 52/726.3, 604, 721.2, 134

(56) References Cited

U.S. PATENT DOCUMENTS 2,128,463 A * 8/1938 Kauffman ..... 52/726.5
4,623,287 A * 11/1986 Eckhardt ..... 408/206
4,641,467 A * 2/1987 Dupuis, Jr. ..... 52/297
4,688,359 A * 8/1987 See ..... 52/134
5,815,897 A * 10/1998 Longstreth ..... 27/1
6,052,954 A * 4/2000 Dudek et al. ..... 27/7
6,279,212 B1 * 8/2001 Balch ..... 27/1

FOREIGN PATENT DOCUMENTS

| | | |
|---|---|---|
| AU | 558428 | 1/1987 |
| FR | 2681624 | 3/1993 |
| FR | 2722229 | 1/1996 |

* cited by examiner

*Primary Examiner*—William L. Miller
(74) *Attorney, Agent, or Firm*—Nilles & Nilles SC

(57) ABSTRACT

A cinerary urn receptacle made of stone comprising a cylindrical block hollowed from one first end to a second end and a cover having a sealing portion and an assembling portion, the sealing portion closing the block first end, the assembling portion projecting from the first end, and the second end comprising an internal countersinking for receiving an inner seal to be fitted on an assembling portion projecting from the cover of another identical receptacle to form a funerary column. The method for making such receptacles from a column turned in natural stone consists in carrying out a double coaxial coring of the column in one single operation to form the block that has a cylindrical recess passing through from a first end to a second end and countersinking of an internal portion of the recess.

9 Claims, 5 Drawing Sheets

CINERARY URN FORMING AN ELEMENT OF A FUNERARY COLUMN AND METHOD FOR MAKING SUCH URNS IN STONE

BACKGROUND OF THE INVENTION

FIELD OF THE INVENTION

The present invention relates to the field of cinerary urns and funerary monuments made of cut stone, natural stone or artificial stone.

During certain funeral ceremonies, it is planned to receive the ashes of the deceased in a cinerary urn which, as desired, is sealed or simply capped before being handed over to the survivors for safe keeping. The ashes are generally collected in a metal vase whose cap has to be sealed before it is placed in a cinerary urn of which there is a wide variety of models, especially made of rock or metal.

There are known cylindrical cinerary urns consisting of a hollow pot made of a monolithic stone block. The stone block is turned on a lathe before being hollowed out by means of a main axial coring operation and then secondary coring operations to obtain the bit-by-bit breakage of the ties between the cored portions and the bottom of the monolithic pot while preventing the breakage of the pot itself. The external surface of the pot often has a lathed or sculptured ornamentation.

These monolithic stone urns have the drawback of high cost because of the large number of coring operations, painstaking operations that are lengthy and costly in terms of labor, tooling and wear and tear of the tools.

Cinerary urns are usually kept individually in a niche in a columbarium or separately in a building.

DESCRIPTION OF THE RELATED ART

The document FR-2 681 624 describes another stone urn obtained by assembling a tubular stone block with stone disks of the same diameter forming a lid and pedestal, one face of the disk being bonded to the end rim of the block. These urns are designed to be preserved and concealed within a funerary monument slab, the urns being inserted in a cylindrical bore of the slab.

These urns are not assembled together and do not, in themselves, constitute a funerary monument that needs to meet aesthetic criteria. These urns also have the drawback of requiring numerous, delicate machining operations, the document FR-2 681 624 providing for a method of preparation in which a stone slab is cored for the extraction, firstly, of a column in obtaining, furthermore, a funeral slab, with a bore, then a part of this column is truncated to obtain disks while the axial part of the remainder of the column is bored, this column then being truncated to obtain the blocks, and finally the disks are bonded to the ends of the blocks.

The document FR-2 722 229 describes another type of cinerary monument formed by pillars and columns formed by a stack of boxes of cinerary urns with a parallelepiped or even cylindrical shape. Each box has an aperture on a lateral face to introduce the cinerary urn, this single side aperture being closed by a door or a plate, while the lower and upper fixed faces comprise shapes in relief, both recessed and raised, which are designed to enable the boxes to get fitted with each other during the stacking. These bulky boxes with a complex shape also have the drawback of requiring numerous steps of fashioning and joining, and have a prohibitive cost such that a stone structure cannot be envisaged.

OBJECTS AND SUMMARY OF THE INVENTION

In an unexpected way, an object of the invention is the making of modular cinerary urn receptacles that can be stacked in funerary columns in order to obtain a stable, sturdy and compact funerary monument with a simple, dignified, and elegant shape.

Another goal of the invention is to achieve the speedy, reliable and low-cost manufacture of cylindrical urns of this kind out of natural stone.

Briefly, these goals are achieved by providing for a modular cinerary urn receptacle made of natural stone comprising a hollow cylindrical block closed at the upper end by a projecting lid, the lower end including a countersinking bore capable of receiving a closing inner seal and receiving the lid of another receptacle.

The invention defines a cinerary urn receptacle made of stone comprising a cylindrical block hollowed out from a first end to a second end and a lid comprising a sealing portion and an assembling portion, the sealing portion sealing the first end of the block, the assembling portion projecting from said first end when the sealing portion seals the first end, the second end of the block comprising an internal countersinking bore capable of receiving an inner seal and capable of receiving an assembling portion projecting from a lid of another identical receptacle to form a funerary column.

The invention is used by forming a funerary column consisting of modular stone cinerary urn receptacles of this kind stackable onto each other, with the lower most urn receptacle stackable on a column base having a projected end portion that can be fitted into the internal countersinking bore of the second end of the lowermost urn receptacle.

Furthermore, according to the invention, it is planned to implement a method for the manufacture of a cinerary urn receptacle from a column lathed out of natural stone, the method comprising the steps of:

- performing a double coring of the column in a single operation to form a hollow block comprising a cylindrical hole crossing from a first end to a second end of the block and a countersinking bore at a second end of the block;
- cutting out plates of natural stone by coring with a drill having an internal diameter greater than the diameter of the hole and less than the diameter of the countersinking bore of the block to form an inner seal and/or a lid disk, and
- performing a tubular coring operation on tile lid disk with a tubular coring drill having an internal dieter slightly smaller than or equal to the diameter of the hole and an external diameter greater than the diameter of the lid disk to form a lid including a shoulder.

BRIEF DESCRIPTION OF THE DRAWINGS

Other features, aims and advantages of the invention shall appear in the description and drawings hereinafter of embodiments given purely on an exemplary basis. In the appended drawings.

DESCRIPTION OF THE PREFERRED EMBODIMENTS

Figure 1:
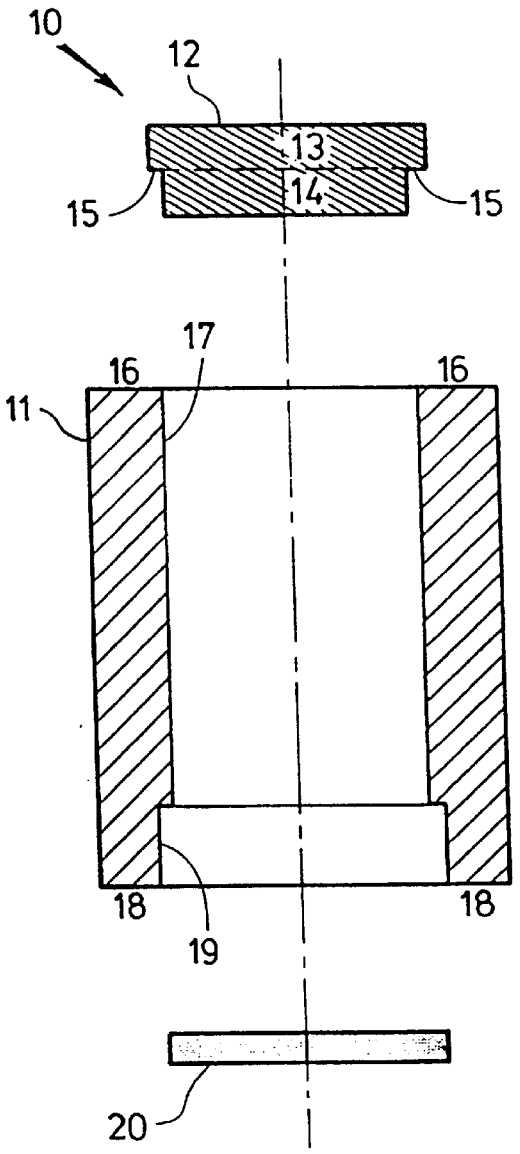
FIG. 1 shows an exploded axial sectional view of a cinerary urn receptacle according to the invention.
Figure 2:
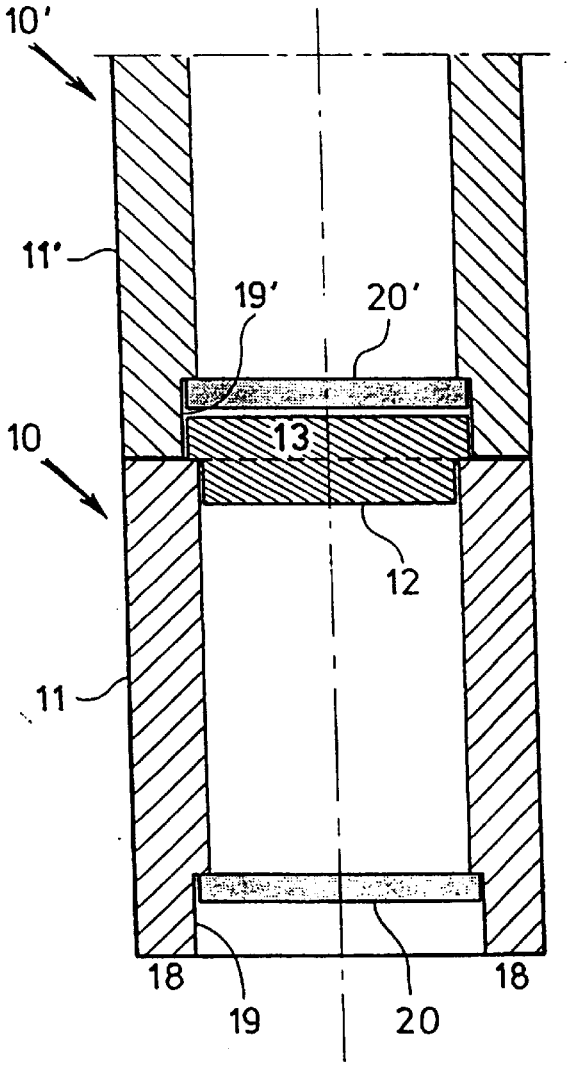
FIG. 2 shows axial sectional views of two cinerary urn receptacles stacked in a column according to the invention.

FIG. 1 illustrates the structure of a cinerary urn receptacle 10 according to the preferred embodiment of the invention. As shown in FIG. 2, multiple urn receptacles can be stacked one on top of the other to form a column.

Figure 6:
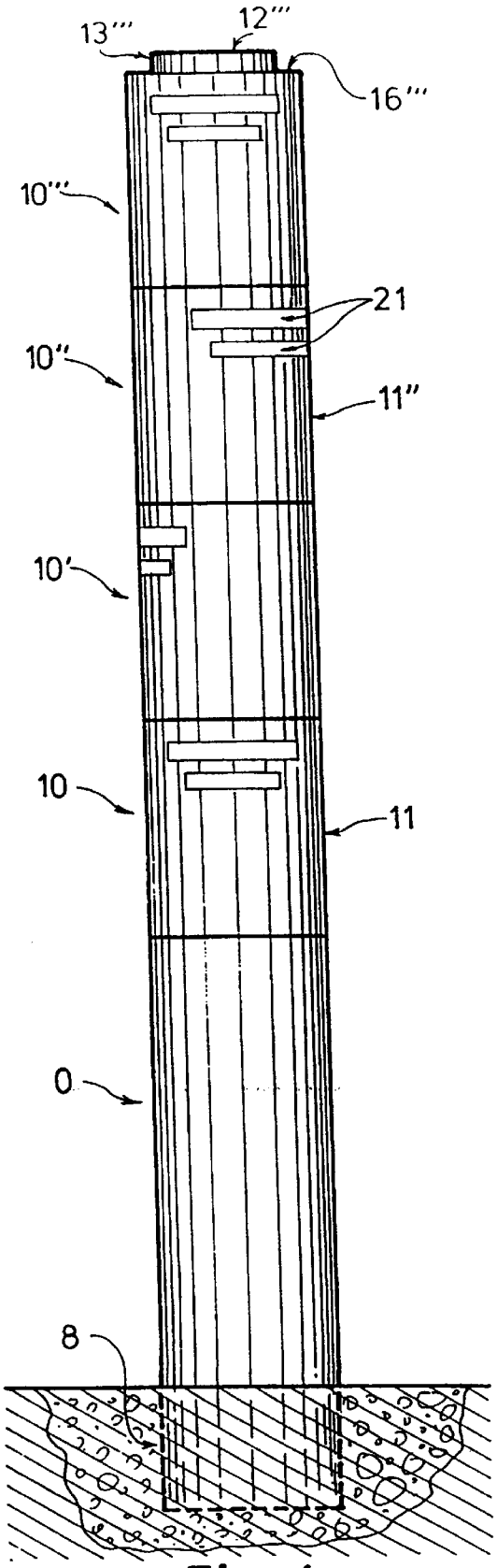
FIG. 6 shows a front view of a funerary column formed by a stack of four cinerary urn receptacles on a column base according to the invention.
Figure 7:
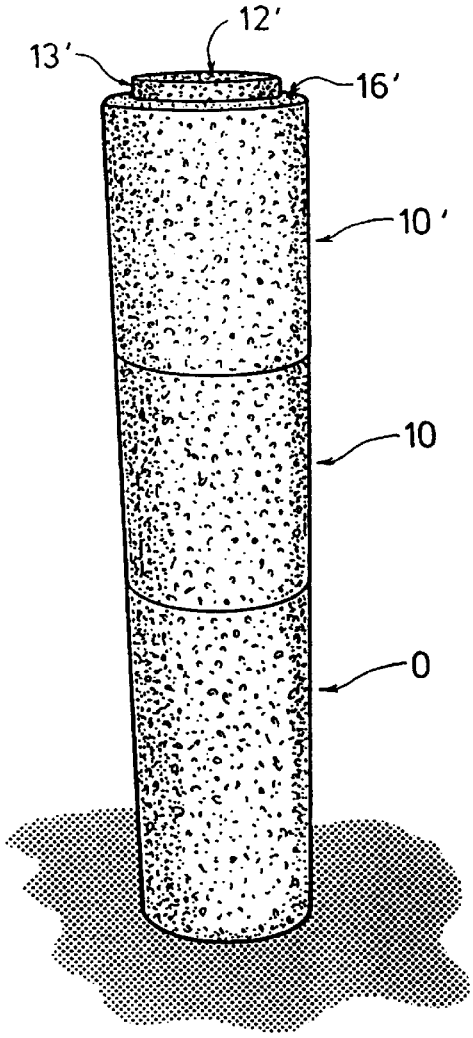
FIG. 7 shows a perspective top view of a funerary column formed by a column base and two stacked cinerary urn receptacles according to the invention.
Figure 8:
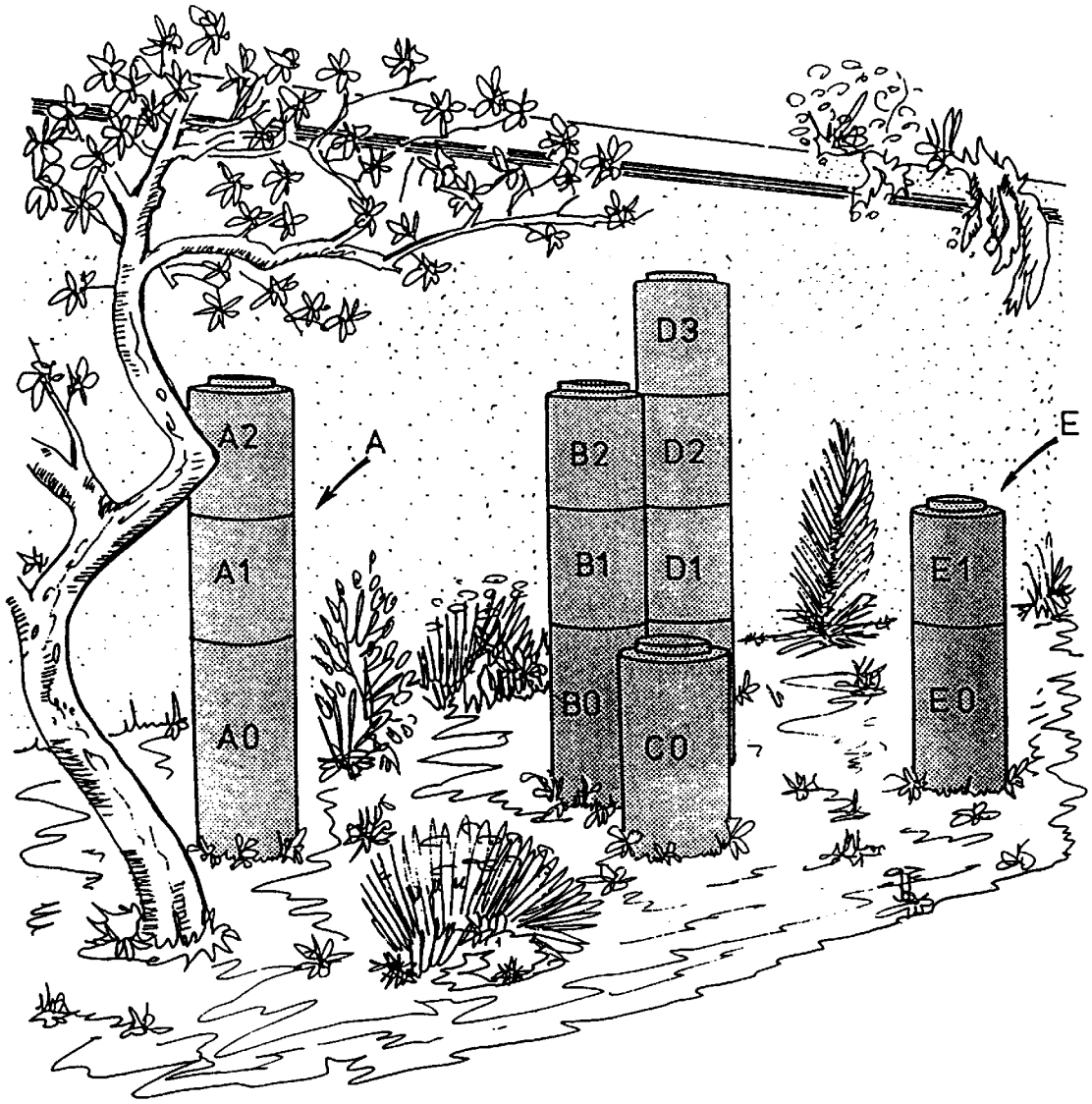
FIG. 8 shows an overall view of the position of several funerary columns comprising stacks of cinerary urn receptacles according to the invention, and, FIGS. 9 to 14 show coring steps in the method for the manufacture of a cinerary urn receptacle made of natural stone according to the invention.

According to the preferred embodiment, the cinerary urn receptacle 10 has a shape of a cylinder that has been generated, for example, by a lathing operation. The urn receptacle has a circular cross section, as shown in FIGS. 6–8, Non-circular embodiments are described in detail below after the description of the preferred embodiment.

The cinerary urn receptacle 10 consists of a hollow cylindrical block 11 and a lid 12 both made of stone.

The urn receptacle 10 once completed will be plugged at a first end 16 of the block 11 by the lid 12.

The urn receptacle 10 is designed then to be closed at a second end 18 by an inner seal 20.

The body of the receptacle 10 is therefore formed by a cylindrical block hollowed out axially from the first end 16 to the second end 18, defining a hole 17.

According to the preferred embodiment shown in FIGS. 1 and 2, the lid 12 is formed out of a stone disk that is cut or notched laterally along a portion of its height, for example along half of its height, to define an assembling portion 13, sealing portion 14, and shoulder 15.

The lid 12 is designed to be fixed to the block at first end 16, preferably by sealing. In particular, the sealing portion 14 is adapted to be sealed to the first end 16 and the assembling portion 13 projects from the block when the sealing portion is sealed to first end 16. In the preferred embodiment, tie sealing portion 14 is adapted to fit within the hole 17 and when the sealing portion 14 is fitted within the hole, assembling portion 13 projects from the first end 16 of the block 11.

In the preferred embodiment, the assembling portion 13 and sealing portion 14 are cylindrical, as is the hole 17, The diameter of portion 13 is greater than the diameter of hole 17 but less than the outer diameter of block 11. Portion 14 has a diameter slightly less than the diameter of hole 17 so as to fit within the hole.

The lid 12 is fitted into and sealed to the first end 16 (the upper end in FIGS. 1 and 2) of the block 11, The sealing is done by means of a mortar, a cement, a bonder or a resin, for example by means of an epoxy bonder. Once the lid 12 has been sealed, assembling portion 13 projects from the first end 16 of the block 11 as can be seen in FIG. 4.

Advantageously, a sealing of this kind ensures the imperviousness and integrity of the receptacle 10 at first end 16.

Figure 4:
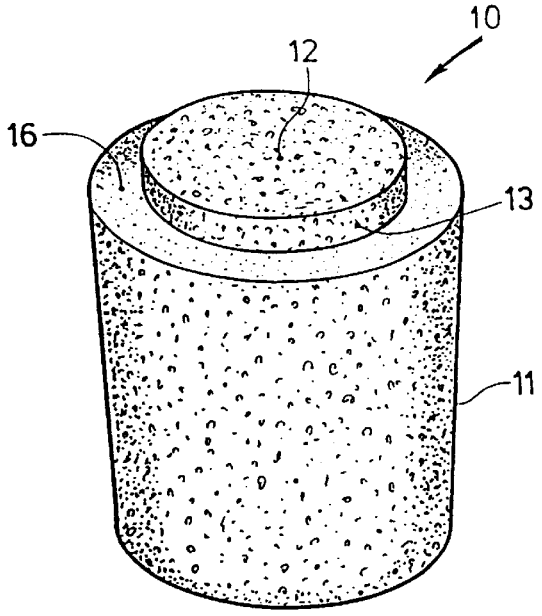

As can be seen in FIG. 4, the urn receptacle 10 with the secured lid 12 defines a male shoulder formed between first end 16 and the projecting portion 13 of the lid 12, because the projecting portion has a diameter greater than the diameter of hole 17 and does not fit within the hole 17.

Now, it is planned according to the invention that the second end 18 of the block will have an internal countersinking bore 19.

Figure 3:
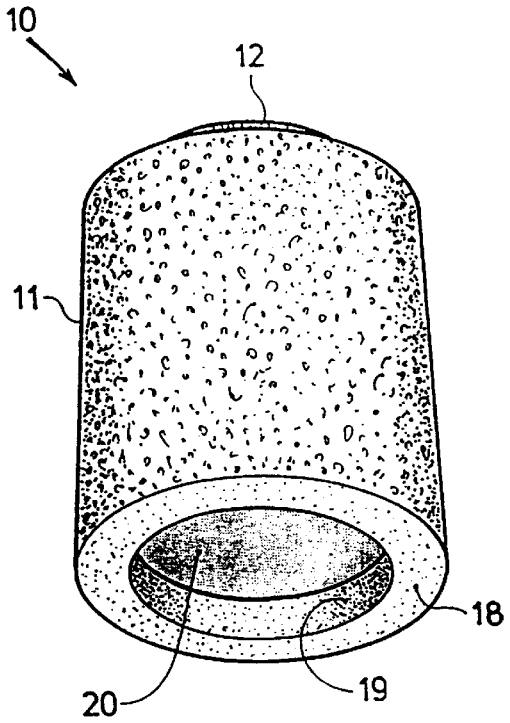
FIGS. 3 and 4 show perspective views, respectively top and bottom views, of a stackable cinerary urn receptacle according to the invention.

Indeed, FIGS. 1 to 3 show that the cylindrical walls of the block 11 are thinner at the second end 18 of the receptacle 10, The internal surface of the block is countersunk by lathing or preferably by coring, to produce a countersinking bore 19 having a height greater than the height of assembling portion 13 projecting from the lid 12.

Indeed, as can be seen in FIG. 2, the countersinking bore 19' of a receptacle 10' is adaptable to receive a cylindrical inner seal 20' with a certain thickness (or axial height) and also receive the assembling portion 13 projecting from the lid 12 of another receptacle 10 identical to the receptacle 10'.

Each receptacle block 10' therefore includes a countersinking bore 19' at second end 18 having a height equal to or greater than the sum of the thicknesses (axial heights) of an inner seal 20' and assembling portion 13 of the lid 12.

Furthermore, the countersinking bore 19 is made slightly larger than portion 13, having a diameter equal to or slightly greater than the diameter of the assembling portion 13 of the lid 12.

Advantageously, the countersinking bore 19 of each receptacle block fulfils a dual function of receiving an inner seal and receiving the projecting assembling portion 13 of lid 12.

In an alternative embodiment (not shown), it is planned that the receptacle lid will be formed by a single cylindrical part made of stone (preferably a disk) and will have no shoulder.

In that case, the block then has, inversely, an internal shoulder that complements a portion of the lid and is formed by a countersinking bore on first end 16 that has a height less than the thickness (or axial height) of the lid.

The countersinking bore produced on first end 16, for example, could have a height of about half the thickness of the cylindrical lid so that when the lid is sealed to the receptacle, the lid has two substantially equal portions: a sealing portion and an assembling portion projecting from the end of the receptacle.

It is planned that the cinerary urn receptacles according to the invention will be made of stone. The stone material may be natural stone, especially cut stone or else a reconstituted stone made out of an aggregate of stone with concrete, mortar or cement.

In the case of a reconstituted stone structure, the receptacle can be manufactured by molding. An embodiment of this kind has the undeniable advantage of low cost.

According to a preferred alternative, the funerary urn receptacle according to the invention is made out of natural stone. The natural stone material is advantageously chosen from among granite, sandstone, basalt, marble, marble-type stone, limestone or any other stone used in the field of funeral equipment.

Preferably, the same natural stone is used for the blocks 11 and the lids 12 corresponding to a column.

The inner seal 20 may be formed by any material, preferably a natural stone or a sedimentary stone. The stone chosen to make the inner seal 20 may be different from that chosen to make the block 11 and/or the lid 12 of the cinerary urn receptacle 10. It is possible for example to make the block and the receptacle lid 10 out of granite and choose a inner seal 20 made of marble.

In the case of an embodiment made of hard natural stone such as granite or marble, it is planned to implement a particular method of manufacture.

Figure 10:
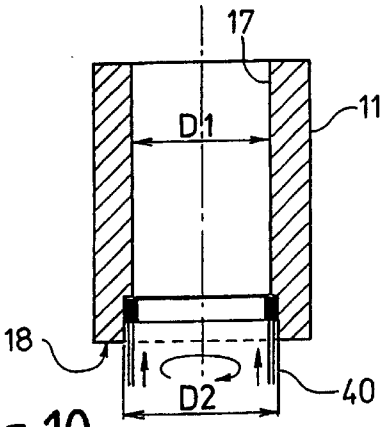
Figure 13:
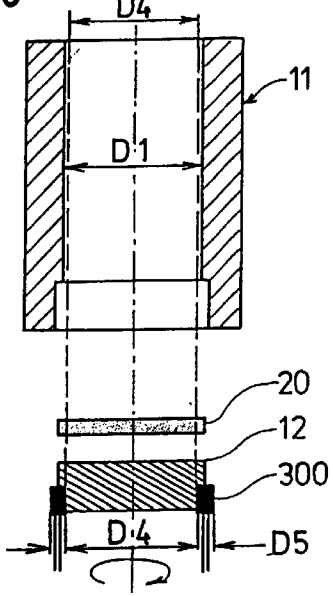
Figure 9:
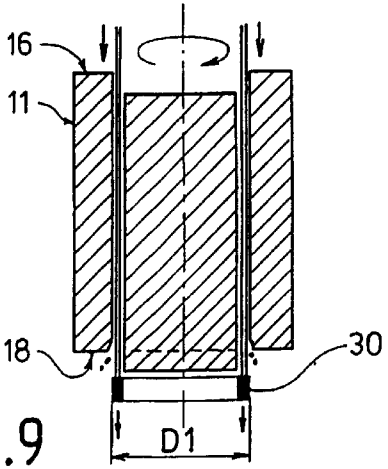
Figure 12:
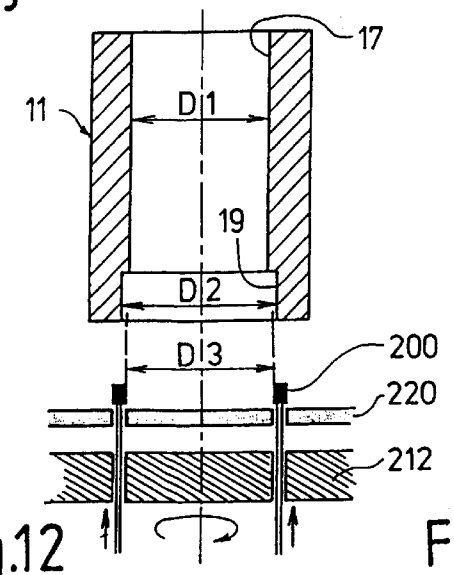

As can be seen in FIGS. 9 and 10, the making of the block can be done in two coring steps A solid column made of natural stone may be subjected to a first axial coring preferably going from the first end 16 to the second end 18, Then, a block is obtained having a uniform cylindrical hole 17. A second axial coring is then performed at the second end 18 of the block on a portion of the height of the block to obtain the countersinking bore 19. The advantage of carrying out the countersinking operation after producing hole 17 and from an opposite end 18 is that it eliminates the splintering of the rim which may appear at the second end 18 when the core drill to produce hole 17 reaches that end, as shown in FIG. 9.

However, each coring operation is a costly operation. A coring operation in a hard, noble stone such as granite or marble requires an operating time of about one hour taking into account the handling operations and precautions needed to not spoil the elements obtained or lose any material.

Advantageously and unexpectedly, the invention provides for the manufacture of a cinerary urn receptacle block in a single coring operation.

Figure 11:
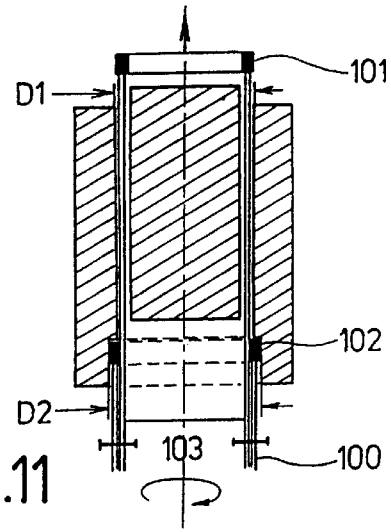
Figure 14:
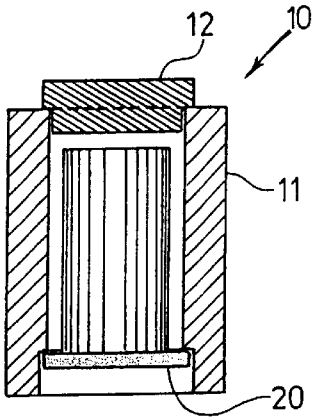

FIG. 11 shows the cylindrical hole 17 and the countersinking bore 19 produced in a single coring step by means of a pair of core drills 101, 102 mounted coaxially and fixedly joined to a shaft 103.

Usually, a core drill has a rotational frequency such that the linear speed of the diamond-tipped tubular ring is close to a value determined by the nature of the material. The nominal rotational speed of a core drill depends on its diameter.

Advantageously, it is planned here that the two matched core drills 101, 102 have diameters of about D1 and D2. This makes it possible to rotate the entire unit 100 at a speed close to the nominal speed corresponding to each of the diameters D1 and D2 in order to tap them efficiently.

The core drill with an external diameter D1 which makes the hole 17 in the block and the core drill with an external diameter D2 which makes the countersinking bore 19 in the block, are mounted coaxially on the shaft 103 with an axial offset equal to or greater than the height of the block minus the desired height of the countersinking bore 19.

Preferably, the manufacture of the lids and inner seals of a cinerary urn receptacle according to the invention is done by coring.

Thus, it is planned to manufacture an inner seal 20 of a receptacle 10 according to the invention by cutting out a plate 220 made of natural stone, especially a cut stone or a sedimentary stone with a thickness in the centimeter range, by coring with a drill having an internal diameter D3 that is greater than the diameter D1 of the hole 17 and less than the diameter D2 of the countersinking bore 19 of each block.

Advantageously, the core drill 200 with an internal diameter D3 is reused to manufacture a receptacle lid according to the invention.

It is therefore planned to cut out a plate of natural stone, preferably the same stone as the one used to make the blocks, by coring with a core drill having an internal diameter D3 that is greater than the diameter D1 of the hole 17 and less than the diameter D2 of the countersinking bore 19 of each block to form a lid disk.

Finally, it is planned to cut by a third complementary coring operation a portion of the lid disk to form a shoulder 15.

This third coring operation is performed with a tubular core drill 300 having an internal diameter D4 equal to or slightly smaller than the diameter D1 of the hole 17 so that the sealing portion 14 of the lid 12 obtained can be inserted and fitted into the hole 17.

Preferably, the external diameter D5 of drill 300 is greater than the diameter D3 of the lid disk so as to advantageously shape a perfectly planar shoulder 15 in a single operation.

Similarly, the core drill 40 or 102 with an external diameter D2, used to produce the countersinking bore 19, preferably has an internal diameter equal to the diameter of the hole 17 to make a flat shoulder between the countersinking bore 19 and the cylindrical hole 17.

One advantage of the method of manufacturing a cinerary stone receptacle according to the invention is that it limits the number of cutting operations, the maximum number of coring operations planned being three.

Now, in funeral practice, it is planned to provide a cinerary urn receptacle 10 that is closed at the first end 16 by sealing the lid 12, the second end 18 being open without any inner seal, the inner seal 20 being provided separately.

Thus, during the funeral ceremony, the ashes or the metal vase containing the ashes may be inserted into the cinerary urn receptacle 10 according to the invention before it is closed by the inner seal 20. Preferably, the vase is mounted on an inner seal 20 coated with silicone before the transfer of the inner seal 20 and the vase, which are held together by the silicone, into the cinerary urn receptacle 10. Advantageously, the inner seal 20 may be easily sealed against the internal shoulder or against the internal surface of countersinking bore 19 at second end 18 of the block 11. After the inner seal 20 has been sealed, the receptacle 10 may be tamed over to be stacked in a column.

Alternatively, it is possible to seal the inner seal 20 at the very outset on the block 11 and leave the lid 12 unsealed.

This lid may then be sealed during the funeral ceremony.

This practice also makes it possible, if need be, to leave the lid 12 freely fitted into the receptacle 10 after the funeral ceremony so as to obtain access to the cinerary vase as desired.

The usefulness of such modular close-fitting cinerary urn receptacles according to the invention can be seen in FIGS. 6 to 8.

It can thus be seen that the cinerary urn receptacles 10, 10', 10", 10'" which are similar can be fitted into one another and stacked to form a funeral column.

It is preferably planned that the funeral column according to the invention will have a simple column base 0 with a projecting end portion 2 capable of fitting into the second end of a receptacle.

Figure 5:
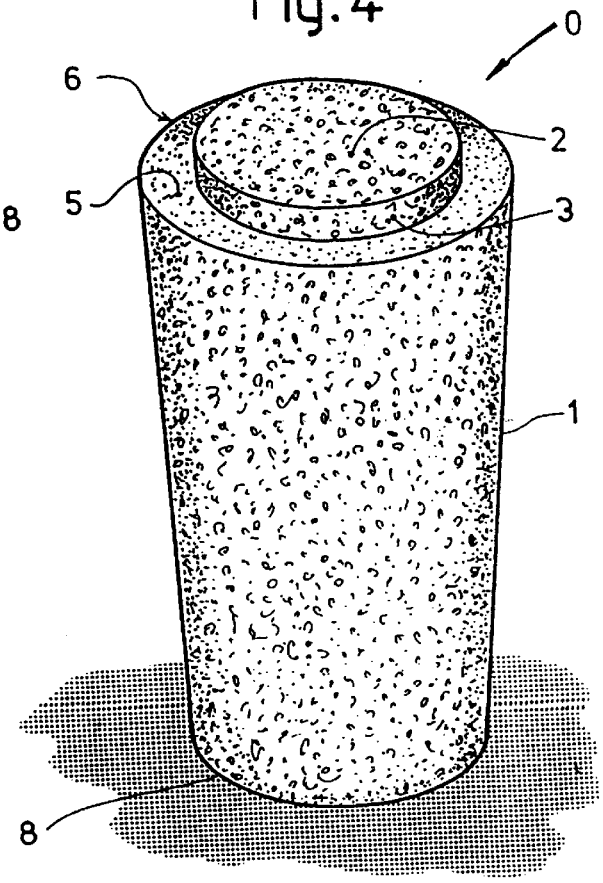
FIG. 5 shows a perspective top view of the column base capable of receiving a sack of cinerary urn receptacles according to the invention.

A base column 0 of this kind, shown in FIG. 5, preferably consists of a solid column body whose rim of the upper end 6 is cut to present a shoulder 5 identical to the shoulder of the second end 16 of each receptacle 10 assembled with its lid 12.

Alternatively, the column base may be made by assembling a tubular column portion that is hollowed out with a lid, as in the case of a receptacle.

It is planned to fix the foot 8 of the column 0 into the ground before stacking a cinerary urn receptacle 10 on top. Preferably, the foot 8 of the column is held still in a pedestal such as concrete or natural stone foundation.

The column 0 advantageously measures several decimeters in height and may reach a height of more than 1 meter so as to form a funerary monument that is stable, solid and dignified, the modular receptacles being placed at eye level.

Columns of this kind may be built as desired in a cemetery, necropolis or private enclosure or even in a family dwelling.

FIG. 8 shows several columns A–E with assemblies of 2D cinerary urn receptacles A1, A2; B1, B2; D1, D2, D3 and E1 on separate column bases A0, B0, C0 and E0.

One useful aspect of the invention is that it can be used to assemble cinerary urn receptacles as desired, in a way similar to that practised in a family vault, for example.

It may be noted in FIG. 6 that it is planned to have an epitaph plate 21 or to carry out an etching on the external surface of the block of each receptacle 11".

Finally, it can be seen that the invention advantageously provides for a compact funerary monument, suited to cremation practices, that is stable, solid and stands up to weather vagaries and is elegant and dignified.

It can also be noted that, according to the preferred embodiment of the invention shown in the figures, the cinerary urn receptacles are symmetrical of revolution, the blocks, lids, and inner seals being circular to form a simple, round, and smooth column.

However, a funerary urn column according to the invention may have an ornamental external surface especially with grooves, ridges, harnesses, twisted features and other sculptures.

More generally, the cinerary urn receptacles according to the invention may have a non-circular cross-section, for example cantoned, square, hexagonal, octagonal, polygonal or any other classical section of a column or pillar.

Similarly, it may be planned that the lid 12 will have a truncated assembling portion 13 (not shown), the countersinking bore 19 of each receptacle 10 then having a complementary truncated surface.

Finally, the top of a column may be surmounted by a capital that is decorative, luminous or has a function of protection against weather vagaries.

Other embodiments, variants and improvements can be implemented by those skilled in the art without departing from the scope of the present invention, the object of the protection being defined by the following claims.

What is claimed is:

1. A cinerary urn receptacle (10) made of stone comprising a cylindrical block (11) having a first end (16) and a second end (18) and including a hole (17) extending from the first end to the second end (16, 18) and a lid (12), characterized in that the lid comprises a sealing portion (14) and an assembling portion (13), the scaling portion adapted to be sealed to the first end (16) of the block, the assembling portion (13) projecting from the first end when the sealing portion (14) is sealed to the first end (16) of the block, and in that the second end (18) of the block includes a countersinking bore (19) receiving an inner seal (20) and capable of receiving an assembling portion of a lid of an identical receptacle to form a funerary column.

2. The cinerary urn receptacle according to claim 1, in which the block (11) is tubular and the lid (12) has a circular cross-section.

3. The cinerary urn receptacle according to claim 2, in which the sealing portion (14) of lid (12) fits within the hole (17) of the block and the assembling portion (13) has a diameter greater than the diameter of the hole (17) but less than the outer diameter of the block (11).

4. The cinerary urn receptacle according to claim 1, in which the sealing portion (14) of the lid gets fitted within the hole (17).

5. The cinerary urn receptacle according to claim 1, in which the assembling portion is a complementary shape to the countersinking bore (19).

6. The cinerary urn receptacle according to claim 1, wherein the stone is a reconstituted stone or a natural stone chosen from among the varieties of granite, sandstone, basalt, marble, and limestone.

7. A funerary column comprising modular cinerary urn receptacles (10, 10') made of stone stacked one on top of another, wherein each urn receptacle comprises a cylindrical block and a lid, wherein the cylindrical block has a first end and a second end and includes a hole extending from the first end to the second end, wherein the lid includes a sealing portion and an assembling portion, the sealing portion adapted to be sealed to the first end of the block, the assembling portion projecting from the first end when the sealing portion is sealed to the first end of the block, and wherein the second end of the block includes a countersinking bore receiving an inner seal and receiving the assembling portion of the lid of the lowermost urn receptacle, with the lowermost urn receptacle fitted onto a column base (0) having a projecting end portion that fits into the countersinking bore (19) of the second end (18) of the lowermost urn receptacle.

8. A method for the manufacture of a modular stone urn receptacle, comprising the steps of:

forming a cylindrical block having a first end and a second end from a piece of natural stone, performing, in a single operation, a double coring of the cylindrical block to form a cylindrical hole crossing from the first end to the second end of the block, and a cylindrical countersinking bore extending from the second end, and producing a plurality of disks adaptable to fit within the countersinking bore by cutting at least one sheet of natural stone by coring using a drill having an internal diameter greater than the diameter of the hole and less than the diameter of the countersinking bore.

9. The method according to claim 8, further including the step of making a lid including a shoulder by performing a tubular coring operation on a selected one of the plurality of disks using a drill having an internal diameter slightly less than or equal to the diameter of the cylindrical hole, and having an external diameter greater than the diameter of the selected disk, and performing the tubular coring operation over a portion of the height of the selected disk.

* * * * *